United States Patent [19]

Bickford et al.

[11] 4,211,958

[45] Jul. 8, 1980

[54] PHANTOM FLUORESCENT LAMP WITH SAFETY SWITCH

[75] Inventors: Elwood D. Bickford, Morris Plains; Joel Shurgan, Westwood, both of N.J.

[73] Assignee: Duro-Test Corporation, North Bergen, N.J.

[21] Appl. No.: 772,844

[22] Filed: Feb. 28, 1977

[51] Int. Cl.[2] ..... H05B 41/16

[52] U.S. Cl. ..... 315/312; 315/97; 315/74; 315/122; 315/179; 315/189; 315/250; 315/324; 328/7

[58] Field of Search ..... 315/99, 122, 95, 47, 315/73, 74, 97, 179, 189, 193, 250, 312, 313, 324, 362; 335/38, 43, 151, 152, 153, 154, 157, 158, 170, 205, 206; 337/22, 23, 27, 182, 377; 328/7; 174/5 R

[56] References Cited

U.S. PATENT DOCUMENTS

| | | | |
|---|---|---|---|
| 3,204,059 | 8/1965 | Saaty | 335/157 X |
| 3,435,286 | 3/1969 | Kayatt | 315/47 |
| 3,829,803 | 8/1974 | Maeda | 335/205 |
| 3,956,665 | 5/1976 | Westphal | 315/95 |
| 4,097,779 | 6/1978 | Latassa | 315/107 |

OTHER PUBLICATIONS

J. E. Shepard, "Mechanically Actuated Electric Switch," IBM Technical Disclosure Bulletin, vol. 14, No. 9, Feb., 1972.

*Primary Examiner*—Eugene R. LaRoche
*Attorney, Agent, or Firm*—Darby & Darby

[57] ABSTRACT

A safe "phantom" lamp structure for replacing a fluorescent lamp in a two-lamp series circuit connected fluorescent fixture which permits the remaining lamp of the two-lamp fixture to operate. The structure includes, in different embodiments, one or more magnetically or thermally actuated switches which must be closed for completion of the phantom lamp circuit and the switches are closed only after connection of both ends of the phantom lamp to the appropriate fixture sockets.

16 Claims, 7 Drawing Figures

PHANTOM FLUORESCENT LAMP WITH SAFETY SWITCH

BACKGROUND OF THE INVENTION

This invention relates to "phantom" lamps and more particularly to such lamps which incorporate safety devices.

Conventional fluorescent lamps generally operate in series circuit connected pairs utilizing a single ballast transformer. Lamps and ballast transformer systems of the so-called rapid start or pre-heat (two-pin) type in which the filaments of a fluorescent lamp are heated, and of the so-called instant start (one-pin) type, in which no filament is provided, are well known.

In response to the energy crisis which began in the early 1970's, attempts were made to conserve energy. In this regard, it was frequently desired to remove one of the lamps from a two lamp fixture leaving the remaining lamp to provide illumination. This end, however, could not be easily accomplished since the two lamps were connected in series and the removal of one lamp prevented the operation of the other. To overcome this problem, two embodiments of a device, commonly referred to as a "phantom" lamp (so-called because the "phantom" lamp is frequently configured to have the same general appearance as a conventional fluorescent lamp), have been provided. In one embodiment, the phantom lamp is merely a conductor which is connected between the two sockets of the fixture which have been vacated by the removal of a lamp. The connection of the conductor between the two sockets completes the circuit, thereby permitting the remaining lamp to operate. In the other type of phantom lamp, the two sockets of the fixture which were intended to receive the removed lamp are connected to one another by a capacitor. Such a phantom lamp is described in U.S. Pat. No. 3,956,665. The type of phantom lamp taught by the noted patent is superior to that of the embodiment in which a mere conductor is provided because the capacitor serves to limit the current in the lamp circuit and to aid in the correction of power factor problems which arise from the removal of one of the fluorescent lamps from the circuit. It will be understood, of course, that neither of the foregoing devices referred to as phantom lamps are truly lamps, since they provide no illumination. They are, as previously stated, either mere conducting wire or a capacitor of appropriately selected capacitance. The devices are, however, customarily enclosed in non-evacuated glass tubes of a size generally equal to that of the fluorescent lamps which they are to replace. The tubes further are provided with capped ends and either one or two pin connectors as appropriate, in the same manner as the fluorescent lamps for which the phantoms are the intended substitutes.

The phantom lamps described above, however, both suffer from a major disadvantage with regard to safety. The danger arises from the possibility that when one end of the phantom lamp is inserted into one socket of a two socket pair, the person inserting the phantom lamp will touch the opposite end of the lamp while such individual is at electrical ground. In such event, a substantial electrical current can flow through the individual causing serious injury or even death.

SUMMARY OF THE INVENTION

It is, therefore, an important object of the present invention to provide a safety connector for completing a series circuit by means of which the aforesaid danger may be most efficaciously avoided.

It is a further object of this invention to provide a safety connector for completing a series circuit in which the connector is electrically continuous only after both ends thereof are connected to appropriate terminals.

It is yet another object of the invention to provide a safety connector for completing a series circuit in which a switching device renders the connector electrically continuous only after both ends thereof are connected to appropriate terminals.

It is still another object of the invention to provide a combination of a fixture for series connected fluorescent lamps and a safety connector substituting for one of the fluorescent lamps wherein switching means is provided for preventing current from flowing in the safety connector until both ends thereof are properly connected within the fixture.

Generally speaking, the objectives of the present invention are attained by the provision of a safety connector adapted to be connected between a pair of spaced terminals substituting for one of a plurality of electrical devices connected in a series circuit comprising conducting means having first and second ends, each end adapted to be connected to a respective one of the spaced terminals for completing the series circuit, and switching means between the first and second ends adapted to render the conducting means electrically discontinuous when either of the first and second ends is not connected to a respective one of the spaced terminals and to render the conducting means electrically continuous when both of the first and second ends are connected to respective ones of the spaced terminals.

The objectives of the present invention are also attained by the combination of a fixture structured so as to maintain a plurality of electrical devices in a series connected circuit, the fixture including a pair of spaced terminals for each of the devices, and a safety connector adapted to be connected between a selected one of the pairs of terminals for substituting for one of the devices and maintaining the continuity of the series circuit, the safety connector comprising conducting means having first and second ends, each end adapted to be connected to a respective one of the selected terminals, and switching means located between the first and second ends adapted to render the conducting means discontinuous when either of the first and second ends is not connected to a respective one of the selected terminals and to render the conducting means continuous when each of the first and second ends is connected to a respective one of the selected terminals.

BRIEF DESCRIPTION OF THE DRAWINGS

The foregoing and other objects and features of the present invention will be more clearly understood from the following detailed description thereof when read in conjunction with the accompanying drawings in which.

DESCRIPTION OF THE PREFERRED EMBODIMENTS

As is well known, conventional fluorescent lamps, whether they are of the so-called instant start or rapid start (pre-heat) type are generally mounted in fixtures which are wired so that the fluorescent lamps mounted in the fixture are connected in series pairs with a ballast system. The ballast system is generally of the auto-transformer type having a primary winding and a series connected secondary winding. In addition, where the fluorescent lamp is of the rapid start or pre-heat type, a number of filament windings are also provided.

Figure 1:
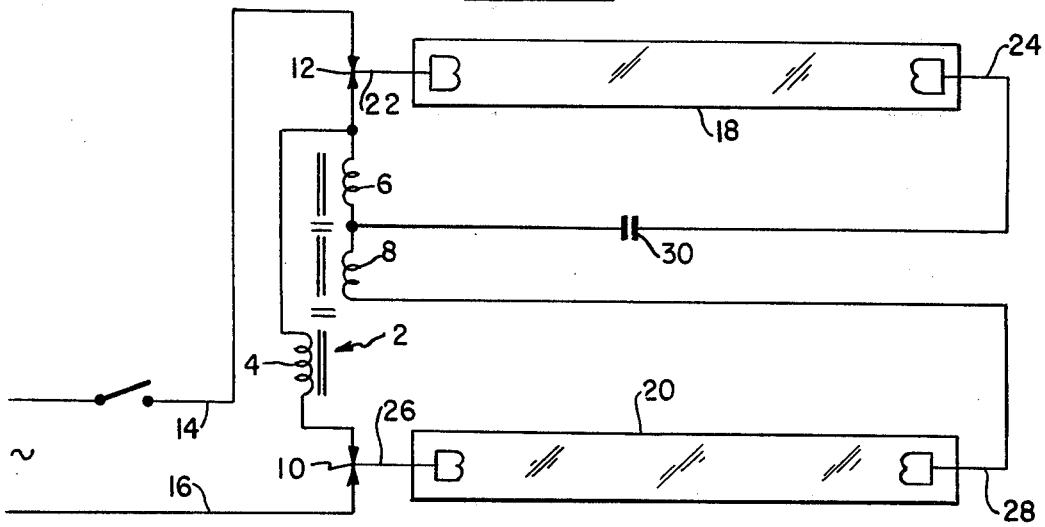
FIG. 1 PRIOR ART
FIGS. 1 and 2 are schematic diagrams illustrating prior art fluorescent lamp circuits for, respectively, instant start and rapid start fluorescent lamps.

Turning now to FIG. 1, there is illustrated a schematic diagram of a circuit conventionally used with fluorescent lamps of the instant start (single-pin) type. The lamp mounting fixture includes a transformer 2 having a primary winding 4, an auxiliary winding 6 and a secondary winding 8. The primary winding is connected to two disconnect sockets, illustrated at 10 and 12, which are connected to the input source lines, indicated at 14 and 16, respectively. It may thus be seen that, when either of the lamps, indicated at 18 and 20, are removed from the disconnect sockets 12 and 10, respectively, no power is provided to the primary winding 4 of the transformer 2. Because the lamps 18 and 20 are of the instant start type, each has a single pin connector, the pins of lamp 18 being indicated at 22 and 24 and the pins of lamp 20 being indicated at 26 and 28. A power factor correcting capacitor, indicated at 30, is generally provided in the fixture circuit for preventing the circuit from being overly inductive and interfering with other electrical appliances in the facility in which the fluorescent lamps are being utilized. As may readily be seen, the removal of either lamp 18 or 20 from the circuit will prevent the operation of the remaining lamp inasmuch as the two lamps are connected in series.

Figure 2:
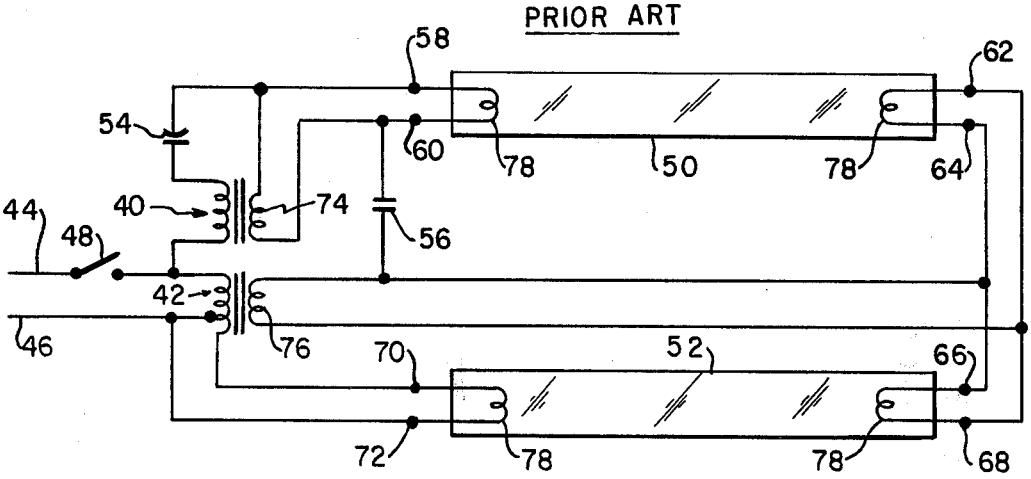
FIG. 2 PRIOR ART

Turning now to FIG. 2, there is illustrated a schematic diagram of a circuit adapted for use with fluorescent lamps of the rapid start or pre-heat type. In this embodiment, the transformer includes a main winding 40, a portion of which, indicated at 42, is connected across the input power lines, indicated at 44 and 46, when a switch 48 is closed. It will be see that the two rapid fluorescent lamps, indicated at 50 and 52, are connected in series with the main winding 40. The fixture circuit includes a power factor adjusting capacitor 54 which serves the same function as discussed previously with respect to capacitor 30 in FIG. 1, and a start capacitor 56 which provides for the ignition of the lamps. In addition, because these are fluorescent lamps of the rapid start or pre-heat type, that is two-pin lamps (the pins of lamp 50 being indicated at 58, 60, 62 and 64 and the pins of lamp 52 being indicated at 66, 68, 70 and 72), filament heating windings, indicated at 74 and 76 are provided. The function of these heating windings is, as is well known, to heat the filaments, each indicated at 78, of lamps 50 and 52. Clearly, in this circuit as well as in the circuit illustrated in FIG. 1, removal of either lamp 50 or 52 will result in an inability to ignite the remaining lamp.

As noted above, it is an object of this invention to provide a safety connector suitable for substituting for one of the series connected lamps in either of the circuits illustrated in FIGS. 1 or 2 which will permit the remaining lamp in the circuit to operate. U.S. Pat. No. 3,956,665, previously referred to, teaches that a suitable connecting device for either of the circuits illustrated in FIGS. 1 and 2 is, in essence, an a.c. capacitor. Inasmuch as the substitution of an a.c. capacitor for one of the lamps in a series connected fluorescent lamp circuit is thoroughly explained in the aforementioned United States patent, the patent providing a complete explanation of the operation of fluorescent lamps and the circuits of FIGS. 1 and 2 as well, no further explanation will here be provided. However, as indicated above, although U.S. Pat. No. 3,956,665 teaches a device which functions satisfactorily as a substitute for a fluorescent lamp, it has been found that the device taught by the patent nevertheless may be dangerous during the substitution procedure.

Figure 3A:
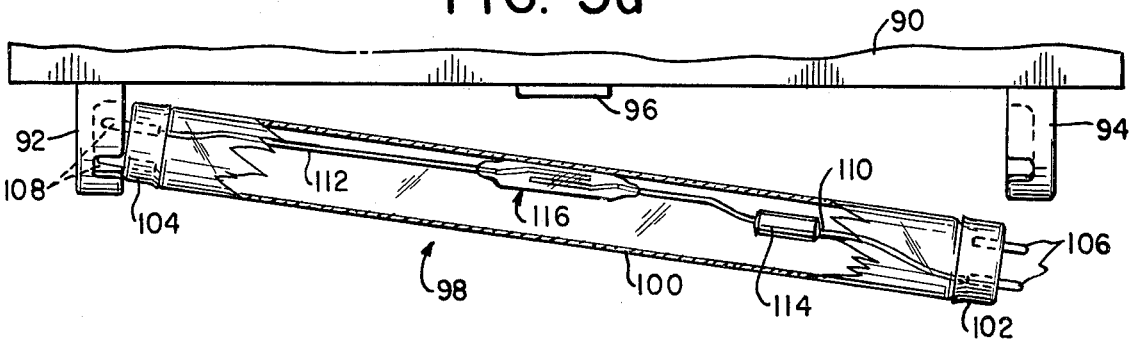
FIGS. 3*a* and 3*b* are elevational views, with parts broken away, of a first embodiment of the invention.
Figure 3B:
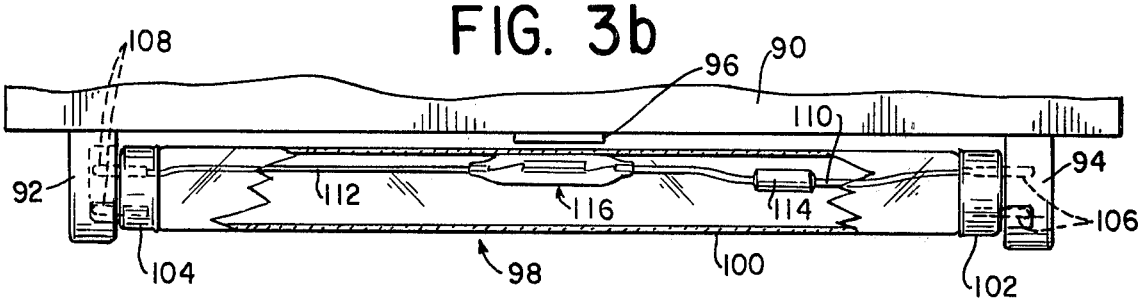

Turning now to FIGS. 3*a* and 3*b*, there is shown a first embodiment of the invention which serves to permit the safe substitution of one lamp in a series-connected circuit containing a plurality of lamps. Referring first to FIG. 3*a*, there is illustrated a combination of a lamp mounting fixture and the first embodiment of the subject invention in elevational view with parts broken away. The safety connector here illustrated is suitable for use in either of the circuits illustrated in FIGS. 1 and 2, that is, in either an instant start or in a rapid start configuration. In FIG. 3*a* it is illustrated utilizing connections suitable for a rapid start (two-pin) lamp. A mounting fixture 90 includes a pair of spaced terminals 92 and 94 and, of course, includes the electrical circuit illustrated in FIG. 2. A magnet, indicated at 96, is also mounted on the fixture 90 and is here illustrated as a permanent magnet although an electromagnet could be used instead. A connector or phantom lamp intended to replace one of the fluorescent lamps of a two-lamp circuit of the kind illustrated in U.S. Pat. No. 3,956,655, which connector is modified by the instant invention, is indicated at 98. The connector 98, which has the physical appearance of a standard fluorescent lamp, includes a hollow tubular glass enclosure 100, end caps 102 and 104 and two pairs of connecting pins or prongs 106 and 108. Fixedly maintained within the tubular enclosure 100, which enclosure need not be evacuated, are conducting wires 110 and 112 which serve to fixedly maintain an a.c. capacitor 114 and a switching device 116. When, as illustrated, prongs 108 are inserted into terminal or receptacle 92, and electrical connection is made therewith, no current will flow from terminal 92 through the end of the conductor 112 which is connected to one of the pins 108 to the end of conductor 110 which is connected to one of the pins 106. This is because the switching device 116, which is here shown as a magnetically actuated reed switch, is in its open position rendering the connection between the conductor 112 and the conductor 110 discontinuous.

Turning now to FIG. 3b, it will be seen that it is only when both pairs of the pins 106 and 108 of the phantom lamp 98 are properly connected to the terminals 94 and 92, respectively, that the magnetically actuated reed switch 116 is sufficiently close, or proximate, to the magnet 96 that the switch will be closed, thereby rendering the electrical connection between the pins 106 and 108, through the ends of conductors 110 and 112, continuous. It will be understood, of course, that the magnet 96, whether it is a permanent magnet or an electromagnet, will be selected so that its strength is sufficient to actuate the magnetic reed switch 116 only when pin pairs 106 and 108 are inserted into terminals 94 and 92, respectively. It will now be realized that a safety phantom lamp or connector has been provided through which current can flow only when both ends of the lamp are properly connected to the appropriate terminals. It is appropriate to note at this point that, as taught by U.S. Pat. No. 3,956,665, an a.c. capacitor having a capacitance in the order of 4 to 6 microfarads can advantageously be utilized in a connector adapted to be substituted for a conventional fluorescent lamp.

Figure 4:
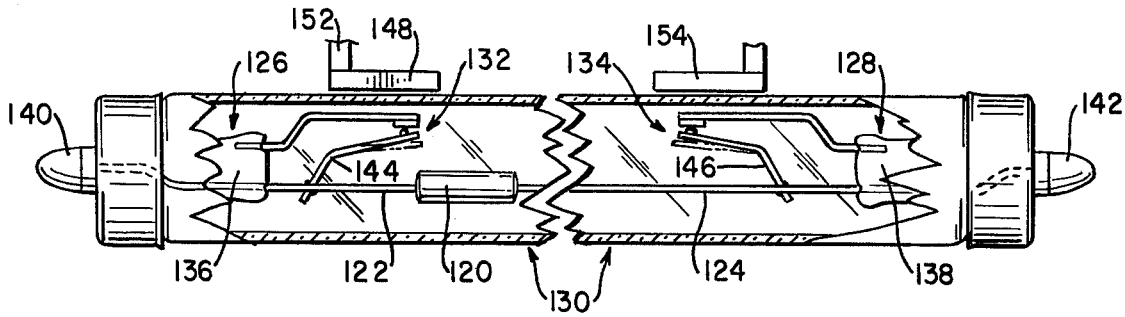
FIG. 4 is an elevational view of a second embodiment of the invention.

Turning now to FIG. 4, there is illustrated an elevational view, with parts broken away, of a second embodiment of the instant invention. In this embodiment, which is illustrated in a configuration suitable for use in a single-pin or instant start lamp but which, it will be understood, is equally suitable for a rapid start lamp as well, a capacitor 120 is connected, by means of conducting leads 122 and 124, to non-conducting mounts 126 and 128, respectively. The foregoing elements are positioned within a tubular envelope 130 as are magnetically actuated reed switches 132 and 134. One terminal of each of the reed switches 132 and 134, indicated at 136 and 138, respectively, is electrically connected to lamp cap pins 140 and 142, respectively. The other contacts of the reed switches 132 and 134, indicated at 144 and 146, respectively, are connected to the ends of conductors 122 and 124, respectively, and the entire structure is fixedly maintained within the tubular member 130, which, as indicated above, need not be evacuated. Mounted on a conventional lamp support fixture (not shown), are two magnets 148 and 150 which are illustrated as permanent magnets, although they may, of course, be electromagnets. Each of the magnets 148 and 150 is connected to the body of the lamp support fixture by a nonmagnetic, non-electrically conducting extender mount indicated at 152 and 154, respectively. The extender mounts are utilized for two primary reasons. Firstly, to position the magnets 148 and 150 relatively close to their corresponding magnetically actuated reed switches, 132 and 134 respectively, and secondly, to prevent excessive perturberance of the provided magnetic field by the tubular member 130.

It may now be seen that in the operation of the structure illustrated in FIG. 4, relay 132 will not close until pin 140 is inserted into the terminal socket provided therefor since reed relay 132 will not be close enough to magnet 148 until pin 140 is so properly inserted. Therefore, until pin 140 is connected to the socket provided, there can be no continuity between conductor 122 and pin 140. In the same manner it will be seen that relay 134 will not close until pin 142 is inserted in its corresponding socket because prior to such connection relay 134 will not be sufficiently close to magnet 150 to be activated thereby. It may therefore be seen that pins 140 and 142 are not electrically connected until the phantom lamp is properly inserted in the sockets provided therefor.

Figure 5:
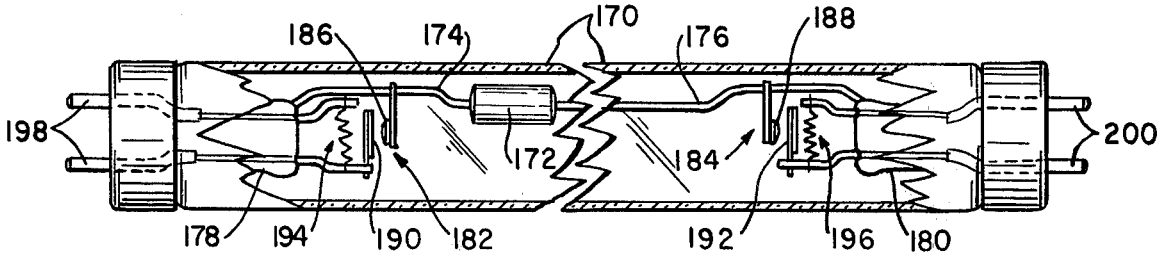
FIG. 5 is an elevational view of a third embodiment of the invention particularly adapted for use in circuits utilizing fluorescent lamps of the rapid start type.

Turning now to FIG. 5, there is illustrated an embodiment of the invention suitable for use in a circuit adapted to receive fluorescent lamps of the pre-heat or rapid start (two-pin) type. The safety connector illustrated in FIG. 5 is similar to that illustrated in FIG. 4 in that a non-evacuated tubular member 170 is used to fixedly maintain an a.c. capacitor 172 of appropriate size. The capacitor 172 is connected, by means of conductors 174 and 176 to non-conducting mounts 178 and 180, respectively. As above stated, the embodiment illustrated in FIG. 5 is particularly adapted for use with circuits of the pre-heat or rapid start type as illustrated in FIG. 2, and to this end, thermally responsive switches 182 and 184 are provided. One end of each of the switches 182 and 184, indicated at 186 and 188, respectively, is connected to a corresponding end of the conductors 174 and 176. The other contacts of the switches 182 and 184, indicated at 190 and 192, respectively, which may be of a conventional bi-metallic construction, are connected to heater filaments 194 and 196, respectively, and through the heater filaments to the pins 198 and 200 at either end of the phantom lamp. It will be seen that in operation, the insertion of the pins located at one end of the lamp into the appropriate one of a pair of terminals will cause the heating filament connected to the pins to operate. This in turn causes the closure of the thermally responsive switch connected thereto, thus permitting electrical continuity between the inserted pins and the thermally responsive switch located at the opposite end of the tube. There will, however, not be any electrical continuity between the pairs of pins 198 and 200 until both pairs of pins are properly inserted and connected to their corresponding terminals. This is because until the respective pairs of pins are appropriately connected to their corresponding terminals both heating elements will not be actuated and therefore, there will be no closure of both the thermally responsive switches.

The embodiment of the invention illustrated in FIG. 5 does suffer a defect in that, although there is no danger of conduction prior to proper installation of the phantom lamp, there is a danger of conduction upon removal of one end of the lamp from the corresponding connector. This is due to the fact that thermally responsive bi-metallic switches are somewhat slow acting and the bi-metallic elements 190 and 192 will remain sufficiently heated to maintain the closure of the switch contacts for a short period of time after removal of the corresonding contacts 198 and 200 from the respective terminals. In the event that it is determined that the danger posed by such a structure is unacceptable, then conventional three volt relays (not illustrated) can be advantageously substituted for the thermally responsive switches and this will completely obviate any danger since the disconnect time of such relays is in the order of milliseconds.

Figure 6:
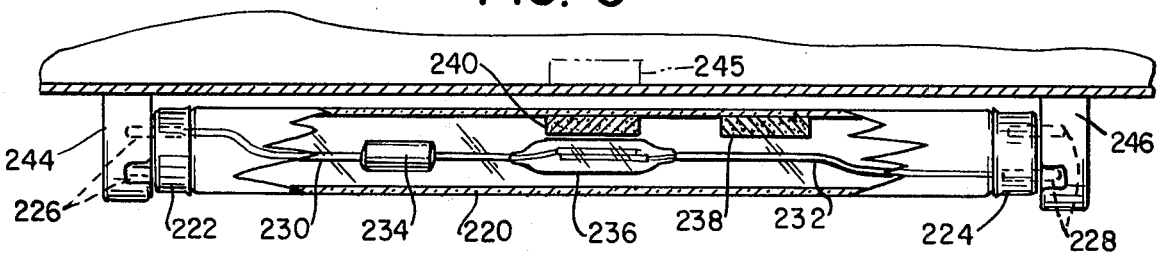
FIG. 6 is an elevational view of a fourth embodiment of the invention.

Turning now to FIG. 6, there is illustrated an elevational view with parts broken away of a fourth embodiment of the instant invention. This embodiment is illustrated in a configuration suitable for use in a rapid start (two-pin) lamp. It will be understood, however, that it is equally suitable for use in an instant start single-pin lamp. This embodiment is similar to those discussed above in that it includes a non-evacuated tubular member 220 formed with end caps which are indicated in a configuration suitable for use in a rapid start circuit, each end cap 222 and 224 includes a pair of connector pins, indicated at 226 and 228, respectively. Conducting wires 230 and 232 are connected to one of the pins 226 and 228, respectively, and these conducting wires serve to fixedly maintain an a.c. capacitor of appropriate size, indicated at 234, and a magnetically actuated switch 236 within the tubular member 220. A magnet 238 and a pole piece 240 are adhered or otherwise mounted on the interior walls of the tubular structure 220. The phantom lamp, when in use, is mounted in a fixture 242 which includes a pair of spaced terminals 244 and 246 into which the pins 226 and 228 respectively,, are inserted.

In operation, the proper insertion of the phantom lamp into end caps 244 and 246 permits both the magnet 238 and the pole piece 240 to be sufficiently close to the fixture 242, which is made from a material which conducts magnetic flux, such as steel, so that the magnetic flux provided by the magnet 238 is conducted to, and attracted by, the pole piece 240 by means of a conducting path provided by the fixture 242. This "actuates" the pole piece 240 to provide sufficient magnetic force to in turn actuate the magnetic switch 236. In this regard, it is noted that the magnetic strength of the magnet 238 must be selected so that, in conjunction with its distance from the switch 236, it is neither close enough, nor powerful enough, to, of itself, and without the path to the pole pice 240 provided by the fixture 242, cause the closing of the magnetic switch 236. It will therefore be seen that, until both ends of the phantom lamp are properly inserted into their respective terminals, either the magnet 238 or the pole piece 240, or both, are a sufficient distance from the flux conducting fixture 242 so that the pole piece 240 does not receive, and therefore cannot transmit, sufficient magnetic force to actuate the switch 236. Rather, it is only when both ends of the phantom lamp are properly located within the end caps of the fixture that both the magnet 238 and the pole piece 240 are sufficiently proximate to the fixture 242 so that the pole piece 240 receives and transmits sufficient magnetic flux to actuate the switch. As indicated previously, and particularly with respect to FIGS. 3*a* and 3*b*, it will be realized that there will not be any electrical continuity between the pins 226 and 228 until both pairs of pins are properly inserted and connected to their corresponding terminals because until the phantom lamp is so positioned the magnetic switch 236 will not be closed.

As indicated above, it is necessary, in utilizing the instant embodiment, to select both the strength of the magnet 238 and its distance from the switch 236 in such a manner that the magnetic flux from the magnet 238 which reaches the switch 236 is insufficient to actuate the switch and that actuation can only occur when both the magnet 238 and the pole piece 240 are sufficiently proximate to the fixture 242, that is, when both pairs of pins 226 and 228 are properly inserted into their respective terminals 244 and 246. The selection of appropriate magnetic strength and appropriate distance may, however, be difficult because the operation of the device is also dependent upon the magnetic conductivity of the fixture 242. The problem arises from the fact that, frequently, at the time of construction of the phantom lamp, the material from which the fixture to be utilized is made is not known. To overcome this difficulty, a modification of the embodiment illustrated in FIG. 6 is provided. To this end a second pole piece 245, indicated in dashed lines in FIG. 6, is incorporated into the structure of the fixture 242. The pole piece 245 is adhered, mounted on, or otherwise connected to the fixture 242 in such a position as to be adjacent to the pole piece 240 only when both ends of the phantom lamp are properly inserted into the corresponding fixture terminals. The pole piece 245 serves to focus, that is direct, the magnetic flux from the magnet 238 (which flux is conducted by the metal fixture 242) to the pole piece 240, thereby causing the actuation of the switch 236. By utilizing the just described modified structure incorporating the pole piece 245, it is possible to utilize a magnet 238 providing a substantially lower magnetic force than would otherwise be required. This is because a magnet providing magnetic force so weak that due to its position it can neither actuate switch 236 prior to the installation of the phantom lamp in the fixture 242, nor actuate the switch 236 via pole piece 240 after insertion into the fixture 242, may actuate the switch because of the focusing of the magnetic flux from the magnet 238 which is provided by pole piece 245.

It will be clear, of course, that many switching devices, other than those illustrated, would be suitable for use in the instant invention. Thus, as was indicated in the discussion of the embodiment of FIG. 5, three volt relays could advantageously be substituted for the thermally responsive switches, Hall-effect devices could also be substituted for the thermally responsive switches.

It may therefore be seen that there has been provided a safety connector suitable for use in completing a series circuit which is safer than presently known devices.

It will be understood that the foregoing description of the preferred embodiments of the present invention are for purposes of illustration only, and that the various structural and operational features as herein disclosed are susceptible to a number of modifications and changes, none of which entail any departure from the spirit and scope of the present invention as defined in the hereto appended claims.

What is claimed is:

1. A safety device for a phantom fluorescent lamp which is adapted to be connected between a pair of spaced electrical voltage supply terminals of a series circuit comprising:

a lamp envelope in the form of a fluorescent lamp and having electrical contact means at each end thereof and electrical conducting means having first and second ends each electrically connected to a respective one of said pair of electrical contact means, each electrical contact means at a respective end of said envelope adapted to be connected to a respective one of said spaced terminals for completing said series circuit; and switching means located internally of the envelope and connected to said electrical conducting means interjacent said first and second ends for rendering said conducting means discontinuous when either of said electrical contact means at said ends of said envelope is not connected to a respective one of said spaced terminals and to render said conducting means continuous when each of said electrical contact means is electrically connected to a respective one of said spaced terminals.

2. A safety device according to claim 1 wherein said switching means comprises:

a first switch within said envelope connected to said conducting means adjacent a first envelope electrical contact means; and a second switch within said envelope connected to said conducting means between said first switch and the other envelope electrical contact means.

3. A safety device according to claim 2 further comprising means for actuating each of said first and second switches to close subsequent to the connection of its corresponding envelope electrical contact means to a respective one of said terminals.

4. A safety device according to claim 3 wherein each of said first and second switches is magnetically actuated and said actuating means comprises magnetically responsive actuator means external of the envelope.

5. A safety device according to claim 3 wherein each of said first and second switches is thermally actuated and located in said envelope adjacent a heating means in the envelope to receive heat therefrom.

6. A safety device according to claim 1 wherein said switching means comprises a single magnetically actuated switch means within said envelope, and further comprising magnetic means for closing said switch means, said magnetic means adapted to be positioned relative to said switch means to actuate said switch means upon both said electrical contact means at the lamp ends being connected to their respective spaced terminals.

7. A safety device as in claim 6 wherein said actuating means comprises a magnet adapted to be mounted external to said lamp envelope.

8. A safety device as in claim 6 where said actuating means comprises a magnet within said lamp proximate to said magnetically actuated switch and which produces a magnetic force insufficient to actuate said magnetically actuated switch, and a magnetically responsive pole piece adjacent said magnetically actuated switch for directing the lines of force thereto when the lamp is placed in a fixture.

9. A safety connector as in claim 8 further comprising a second pole piece adapted to be mounted in said fixture in magnetic flux receiving relationship to said first-named pole piece.

10. In combination, a fixture for a plurality of fluorescent lamps in a series connected circuit, said fixture including a pair of spaced voltage supply terminals for each of said lamps and a safety device for a said lamp adapted to be connected between a selected one of said pairs of terminals for substituting for one of said lamps and maintaining the continuity of said series circuit, said safety device comprising:

a lamp envelope in the form of a fluorescent lamp envelope and having electrical contact means at each end thereof, electrical conducting means having first and second ends each electrically connected to a respective one of said pair of electrical contact means, each electrical contact means at a respective end of said envelope adapted to be connected to a respective one of said selected terminals; and switching means within said lamp envelope connected to said electrical conducting means interjacent said first and second ends for rendering said conducting means discontinuous when either of said electrical contact means at said ends of said envelope is not connected to a respective one of said selected terminals and to render said conducting means continuous when each of said electrical contact means is electrically connected to a respective one of said selected terminals.

11. The combination of claim 10 wherein said switching means comprises:

a first switch within said envelope connected to said conducting means adjacent a first envelope electrical contact means; and a second switch within said envelope connected to said conducting means between said first switch and the other electrical contact means.

12. The combination of claim 11 wherein said first and second switches are magnetically actuated and said switching means further comprises first and second magnetic means supported by said fixture, said first and second magnetic means being proximate to, and closing, said first and second switches, respectively, when the corresponding electrical contact means at each end of the envelope is connected to a respective one of said selected terminals.

13. The combination of claim 11 wherein said first and second switches are thermally responsive and said switching means further comprises first and second heating elements in said envelope positioned proximate said first and second switches, respectively, each of said heating elements operating for closing its respective switch when the corresponding electrical contact means at each end of the envelope is connected to a respective one of said selected terminals.

14. The combination of claim 10 wherein said switching means comprises:

a single magnetically actuated switch within said envelope; and magnet means supported by said fixture, said magnetic means and said switch are located with the magnet means being proximate to and closing said switch when both of said electrical contact means at the envelope ends are connected to their respective terminals.

15. The combination of claim 10 wherein said fixture includes a portion of a magnetic flux conductive material and wherein said switching means comprises:

a magnetically actuated switch within said envelope; and magnetic means fixedly maintained a selected distance from said switch; and a first magnetic pole piece fixedly maintained adjacent to said switch, one of said magnetic means and first magnetic pole piece being within the envelope and the other mounted to said fixture, whereby the magnetic flux from said magnetic means is conducted to said first pole piece by said fixture for actuating said switch only when each of said electrical contact means is connected to a respective one of said selected terminals.

16. The combination of claim 15 further comprising a second magnetic pole piece connected to said fixture and positioned so as to be adjacent to said first pole piece only when each of said electrical contact means is connected to a respective one of said selected terminals, whereby said second pole piece serves to direct the magnetic flux from said magnetic means to said first pole piece.

* * * * *